US006062465A

United States Patent [19]

Kearns

[11] Patent Number: 6,062,465

[45] Date of Patent: May 16, 2000

[54] ENVELOPE

[75] Inventor: Hugh Kearns, Dublin, Ireland

[73] Assignee: Datablend Limited, Dublin, Ireland

[21] Appl. No.: 09/068,668

[22] PCT Filed: Nov. 13, 1996

[86] PCT No.: PCT/IE96/00074

§ 371 Date: Jun. 29, 1998

§ 102(e) Date: Jun. 29, 1998

[87] PCT Pub. No.: WO97/18136

PCT Pub. Date: May 22, 1997

[30] Foreign Application Priority Data

Nov. 13, 1995 [IE] Ireland ..... s950871

[51] Int. Cl.[7] ..... B65D 27/06; B65D 27/08

[52] U.S. Cl. ..... 229/70; 229/305; 229/306; 229/72

[58] Field of Search ..... 229/70, 305, 306, 229/72

[56] References Cited

U.S. PATENT DOCUMENTS

| | | | |
|---|---|---|---|
| 3,764,061 | 10/1973 | Hulbert | 229/70 |
| 4,190,162 | 2/1980 | Buescher | 229/305 X |
| 4,815,654 | 3/1989 | Buescher | 229/305 |
| 5,169,061 | 12/1992 | Buescher | 229/305 |
| 5,248,082 | 9/1993 | Elminger | 229/305 X |
| 5,307,989 | 5/1994 | Dyer | 229/305 |
| 5,346,124 | 9/1994 | Chess | 229/305 |

FOREIGN PATENT DOCUMENTS

| | | | |
|---|---|---|---|
| 2167381 | 5/1986 | United Kingdom | 383/5 |

*Primary Examiner*—Jes F. Pascua
*Attorney, Agent, or Firm*—Hoffmann & Baron, LLP

[57] ABSTRACT

An envelope for holding contents and receiving a date-indicating means having a plurality of panels connected together to form at least one pocket. The envelope has a closure flap moveable between an open position that allows the contents to be placed within the pocket and a closed position for sealing the contents within the pocket. A detachable receipt-defining portion is connected to one of the plurality of panels by at least one connection line. A field for receiving the date-indicating means is positioned along the connection line. After the date-indicating means is applied and the receipt-defining portion is detached, the closure flap seals a remaining part of the field when in the closed position.

8 Claims, 8 Drawing Sheets

ENVELOPE

BACKGROUND AND SUMMARY OF THE INVENTION

The present invention relates to an envelope comprising
(a) panels connected together to form at least one pocket;
(b) a closure flap, which is moveable between an open position and a closed position in which it seals the pocket and the contents therein;
(c) a receipt-defining portion detachably connected to the envelope by at least one connection line; and
(d) field indicating means, such as lines or an array of different colours defining a field for receiving a date-indicating means such as a date stamp or signature and date.

The invention also relates to a method of using such an envelope.

When a person wishes to make a record of when a work such as a drawing, writing, sketch, photograph or painting has been produced, it is customary for the creator of the work to send a copy of the work to himself or herself by registered post. The creator then keeps the registered envelope unopened in a safe place. If the creator ever has to establish copyright or moral rights in a work, the registered envelope could be opened in Court with a view to establishing that the work was in existence as of the date of posting of the registered envelope.

The difficulty with such a system is that it is not completely reliable from an objective point of view and the envelope could be tampered with. There does not exist in the market any suitable envelope which can provide such objective certainty.

Prior art envelopes and bags of various types including some form of tamper-evident security indicators, are known. However, these known types suffer from certain disadvantages and cannot provide a solution to the problem outlined above.

The envelope of the present invention seeks to alleviate the disadvantage associated with the prior art.

According to the invention this object is achieved in that
(e) the field is positioned such that one of the connection lines for receipt-defining portion runs through this field; and
(f) the closure flap seals the remaining part of the field when in a closed position after detaching the receipt-defining portion.

Preferably, the receipt-defining portion is detachably connected to the envelope by at least one line of perforations.

Advantageously, the plurality of panels comprise a top panel, an intermediate panel and a base panel.

Conveniently, the receipt-defining portion is connected to the closure flap of the envelope.

Preferably,
(a) the panels being rectangular with the same width;
(b) the top panel and the base panel having the same length exceeding the length of the intermediate panel;
(c) the intermediate panel fixed to the base panel and thereby forming a first pocket;
(d) the top panel being divided into three sub-panels by two lines of perforations, the first sub-panel being fixed to the intermediate panel at three sides and thereby forming a second pocket, the second sub-panel being the removeable receipt-defining portion and the third sub-panel being fixed to the portion of the base panel exceeding the intermediate panel, the two portions forming the closure flap, which closes the first pocket; and
(e) the field for receiving a date-indicating means being positioned along the perforation line between the second and the third sub-panel.

Advantageously, an adhesive strip is provided
(a) on the third sub-panel;
(b) on the closure flap to seal the first pocket; and
(c) inside the mouth of the second pocket so as to seal the second pocket.

Alternatively,
(a) the envelope consists of a top and a bottom panel forming a single pocket;
(b) the top panel consists of a first sub-panel forming the receipt-defining portion and a second sub-panel forming the top part of the pocket; and
(c) the portion of the bottom panel which exceeds the top panel after removing the receipt-defining portion forms the closure flap.

Conveniently, the adhesive strip is provided on the closure flap to seal the pocket.

The present invention also provides a method of using an envelope, the method comprising the following steps:
(a) inscribing a user's signature and date of signature along the connection line running through the field for receiving a date-indicating means;
(b) detaching the receipt-defining portion with a portion of text of the signature and date being provided on the receipt-defining portion and the remaining portion of signature and date remaining on the envelope;
(c) inserting material, such as documentation, in the first pocket and sealing the first pocket; and
(d) dispatching/delivering the envelope to a registration depository.

Preferably, the method may also comprises the additional step of inserting the receipt-defining portion into the second pocket and sealing the second pocket before dispatching/delivering the envelope to a registration depository.

The envelopes of the present invention will now be described more particularly with reference to the accompanying drawings which show, by way of example only, two embodiments of an envelope in accordance with the present invention.

DETAILED DESCRIPTION OF THE PREFERRED EMBODIMENTS

Figure 1:
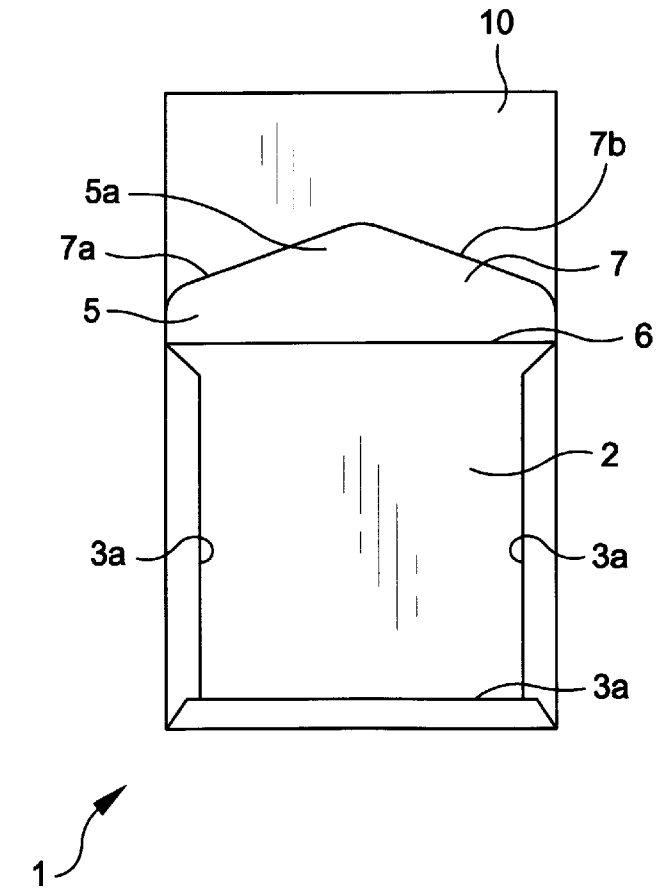
FIG. 1 is a rear view of the envelope in a first embodiment showing the rear panel with the closure flap and receipt-defining flap member in respective open positions in which they extend laterally from and co-planar with the back panel of the envelope.
Figure 4:
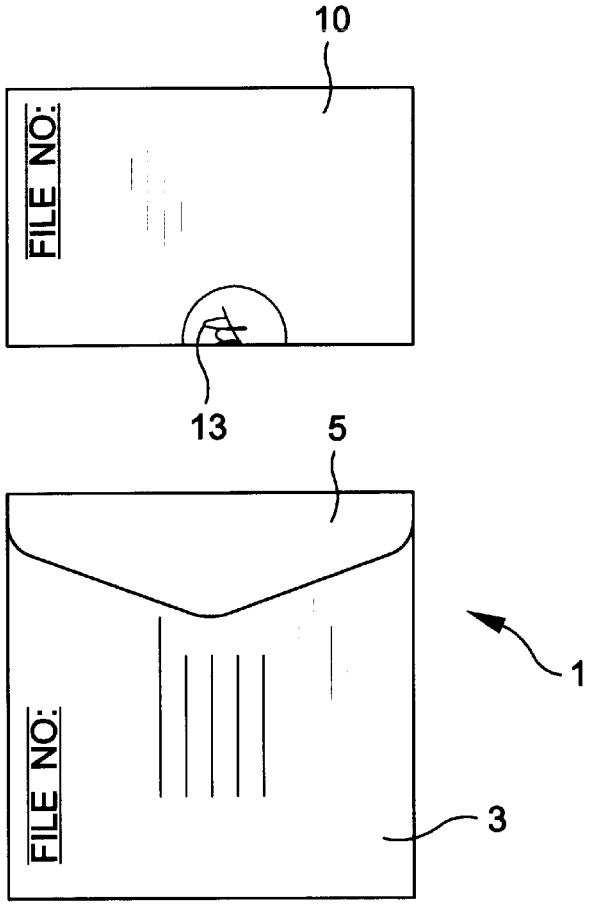
FIG. 4 is a front view of the envelope in the first embodiment with the closure flap in the closed position in which it is adhered to the front panel of the envelope.
Figure 3:
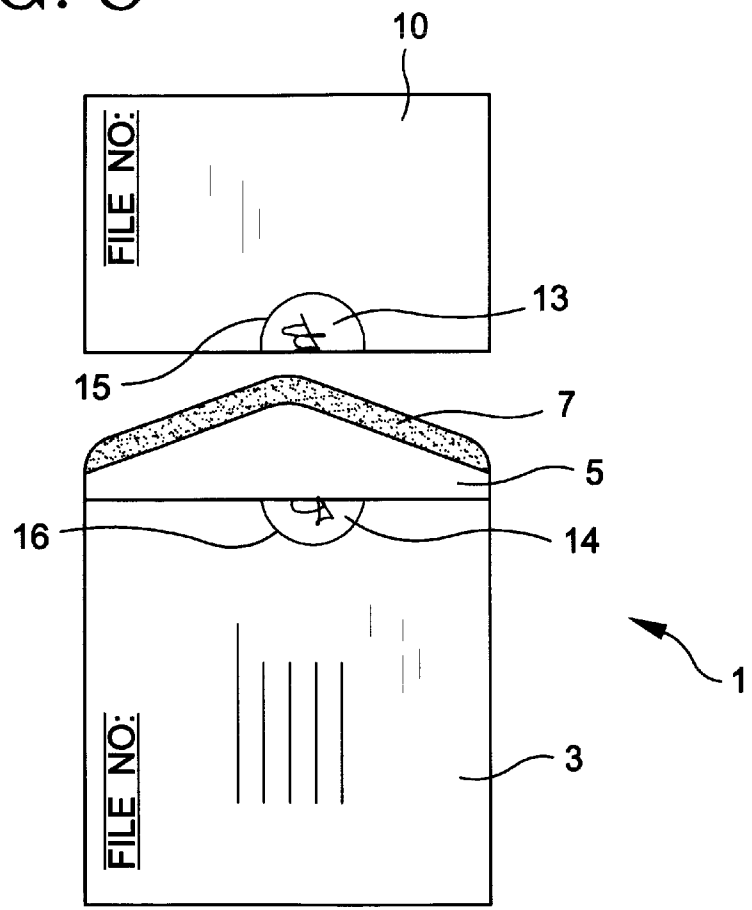
FIG. 3 is a front view of the envelope of the first embodiment with the receipt-defining flap member detached from the envelope and with the closure flap in its open position.
Figure 5:
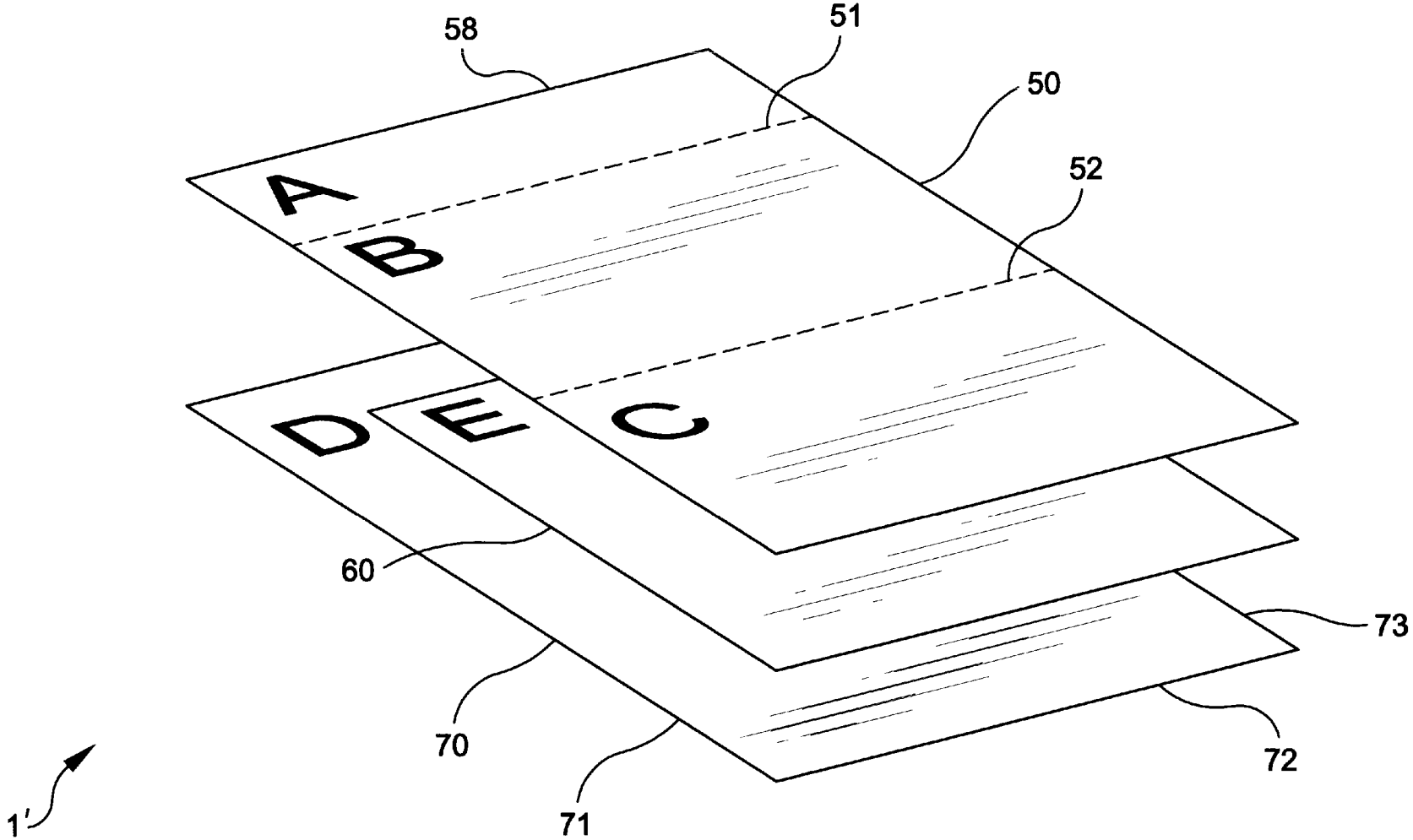
FIG. 5 is an exploded perspective view of a second embodiment according to the invention, showing a top panel, intermediate panel and bottom panel of the envelope.
Figure 6:
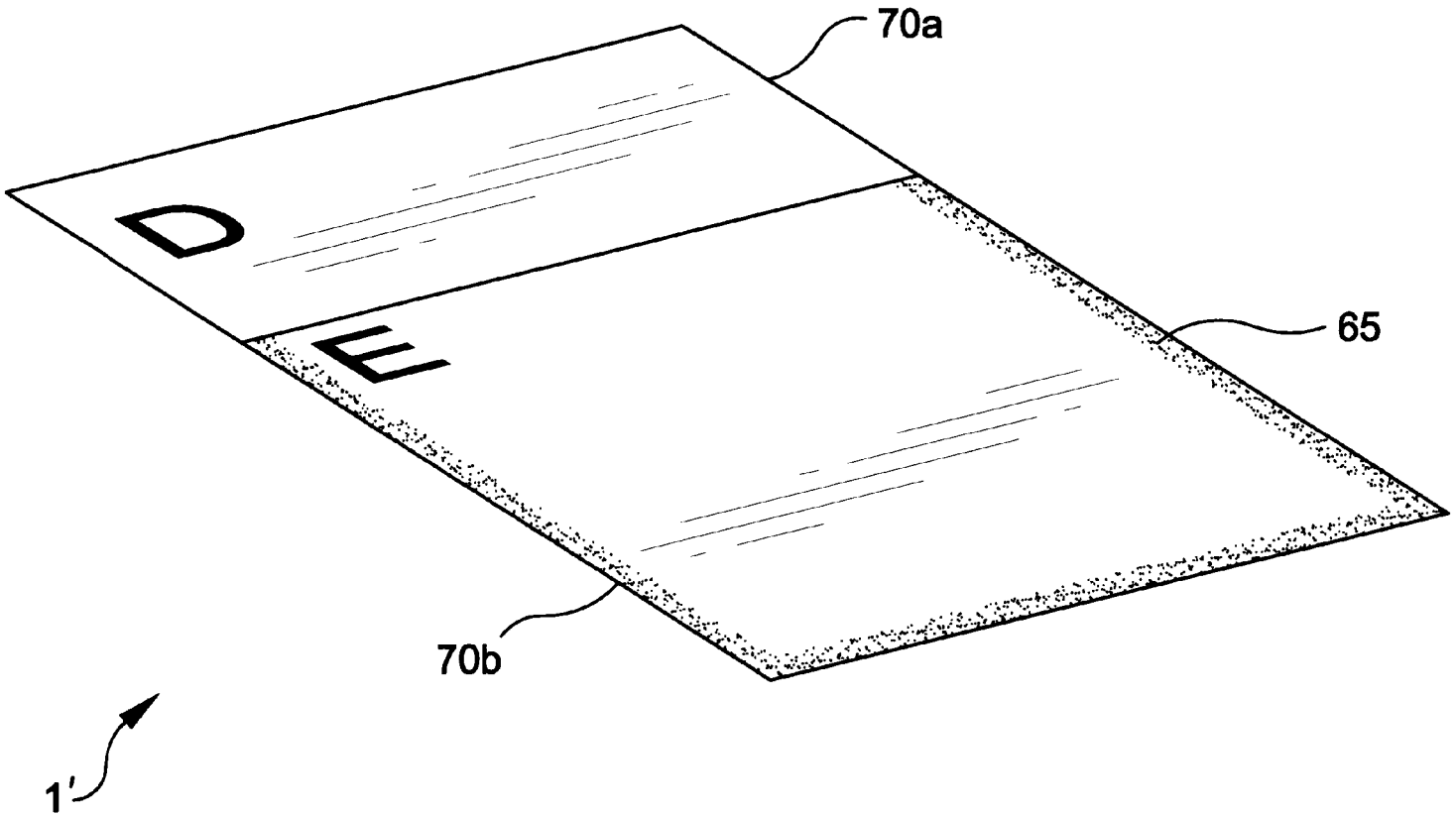
FIG. 6 is a perspective view of the intermediate and bottom panels of the envelope of the second embodiment joined together to form a main pocket.

Referring to the drawings, an envelope of a first embodiment of the invention is indicated generally by reference numeral 1. The envelope 1 includes a back panel 2 and a front panel 3. Preferably the front panel 3 includes a plurality of connection flaps 3*a* for forming a connection between the front panel 3 and the back panel 2. The envelope also comprises a closure flap 5 which is attached to the back panel 2 along a crease line 6. The closure flap 5 has adhesive applied along the perimeter 7 on the underside of the closure flap 5. As shown in FIG. 1, the closure flap 5 preferably includes a substantially triangular portion 5*a* with the perimeter 7 defined by at least two sides 7*a*, 7*b*. The closure flap 5 is moveable between an open position in which it extends laterally from and co-planar with the back panel of the envelope, and a closed position in which it is lying adjacent the front panel 3 and in which it can be adhered to the latter by means of the adhesive applied to the perimeter 7 of the closure flap 5.

The envelope 1 also includes a receipt-defining flap member 10 which is detachably connected to the front panel 3 along a line of perforations 11. Thus, the receipt-defining flap member 10 may be detached from the front panel 3 by tearing along the line of perforations 11. The receipt-defining flap member 10 is also moveable in a pivot-like fashion about this line of perforations 11 between an open and closed position.

The envelope also preferably includes a field 15 having first and second parts 16, 71 for receiving a date-indicating means. The field 15 is preferably positioned across and substantially centered along the line of perforations 11. The first part 16 is a portion of the front panel 3 and the second part 17 is a portion of the receipt-defining flap member 10.

The envelope 1 has the advantage that it provides a means of containing documentary material while providing evidence of the date on which the documentary material was available and was placed securely inside the envelope.

Figure 2:
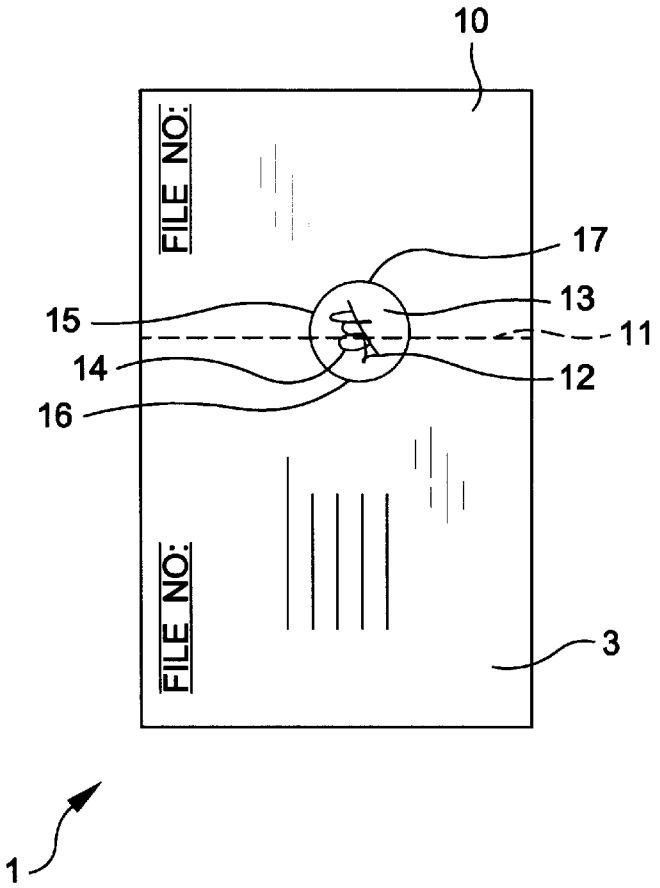
FIG. 2 is a front view of the envelope of the first embodiment with the receipt-defining flap member in the open position and showing the location of a date stamp imprinted across the line of perforations connecting the receipt-defining flap member with the front panel.

Use of the envelope will now be described with reference to the drawings. In order to identify the envelope 1 and receipt-defining flap member 10, a file number and owner's name and address are printed on both the front panel 3 and the receipt-defining flap member 10. Documentary material may be inserted into the envelope 1 as may be witnessed by an official and the envelope may be presented to the official at a central registration office or a post office. The official moves the receipt-defining flap member 10 and closure flap 5 into their respective open positions in which the line of perforations 11 is exposed. The official then randomly imprints a date-stamp 12 on the envelope 1, for instance, at the location shown in FIG. 2. That is to say that the date stamp 12 is located somewhere along the line of perforations 11 with the result that a portion 13 of the date stamp 12 is imprinted on the receipt-defining flap member 10 and another portion 14 of the date stamp 12 is located on the front panel 3 of the envelope 1. The receipt-defining flap member 10 may then be detached from the front panel 3 by tearing along the line of perforations 11. This receipt-defining flap member 10 is handed to the person who placed the material in the envelope and held by him in a safe place. The closure flap 5 is then closed by the official and sealed onto the front panel 3.

The closure flap 5 will then conceal the portion of the date stamp 14 on the front panel 3 of the envelope 1. The sealed envelope 1 may be securely stored at a central depository which is provided for storing such envelopes 1.

When there is a need to show beyond doubt that the material in the envelope was in the possession of a particular person at a particular date, the envelope 1 may be retrieved from the central depository by the person in possession of the corresponding receipt-defining flap member 10. When the closure flap 5 is subsequently opened, the date on which the envelope 1 was sealed can be proven conclusively by virtue of the fact that the receipt 10 bears the corresponding portion 13 of the date stamp matching the other portion 14 on the front panel of the envelope 1. The receipt-defining flap member 10 thus serves as a receipt since it can subsequently be produced and matched up with the portion 14 of the date stamp on the front panel 3.

Referring now to FIGS. 5 to 10 an envelope in accordance with a second embodiment of the invention and the method for using that envelope will be described.

The envelope of the second embodiment is indicated generally by the reference numeral 1'. The envelope 1' comprises a top panel 50 and base panel 70 having an upper portion 70*a* and a lower portion 70*b*. These panels have the same dimensions. The top panel 50 is joined to the base panel 70 along one edge only, namely along the edge indicated by numeral 58 on the top panel 50. The top panel 50 is provided with two perforated lines 51,52. The perforated lines 51,52 divide the top panel 50 into first, second and third sub-panels designated as C, B, and A respectively in the drawings.

The envelope 1' also includes an intermediate panel 60 (panel E) which is of a shorter length than both the top panel 50 and base panel 70 (panel D). The intermediate panel 60 is adhered to the lower portion 70*b* of the base panel 70 at three edges of the base panel 70, namely edges 71,72 and 73 respectively, thereby defining and providing a main pocket 65. In turn, the top panel 50 is adjoined to the intermediate panel 60 substantially along the three edges of the sub-panel C of the top panel 50 thereby forming an auxiliary pocket 55 between sub-panel C and the intermediate panel 60. (The intermediate panel 60 is also indicated as panel E in the drawings).

Figure 9:
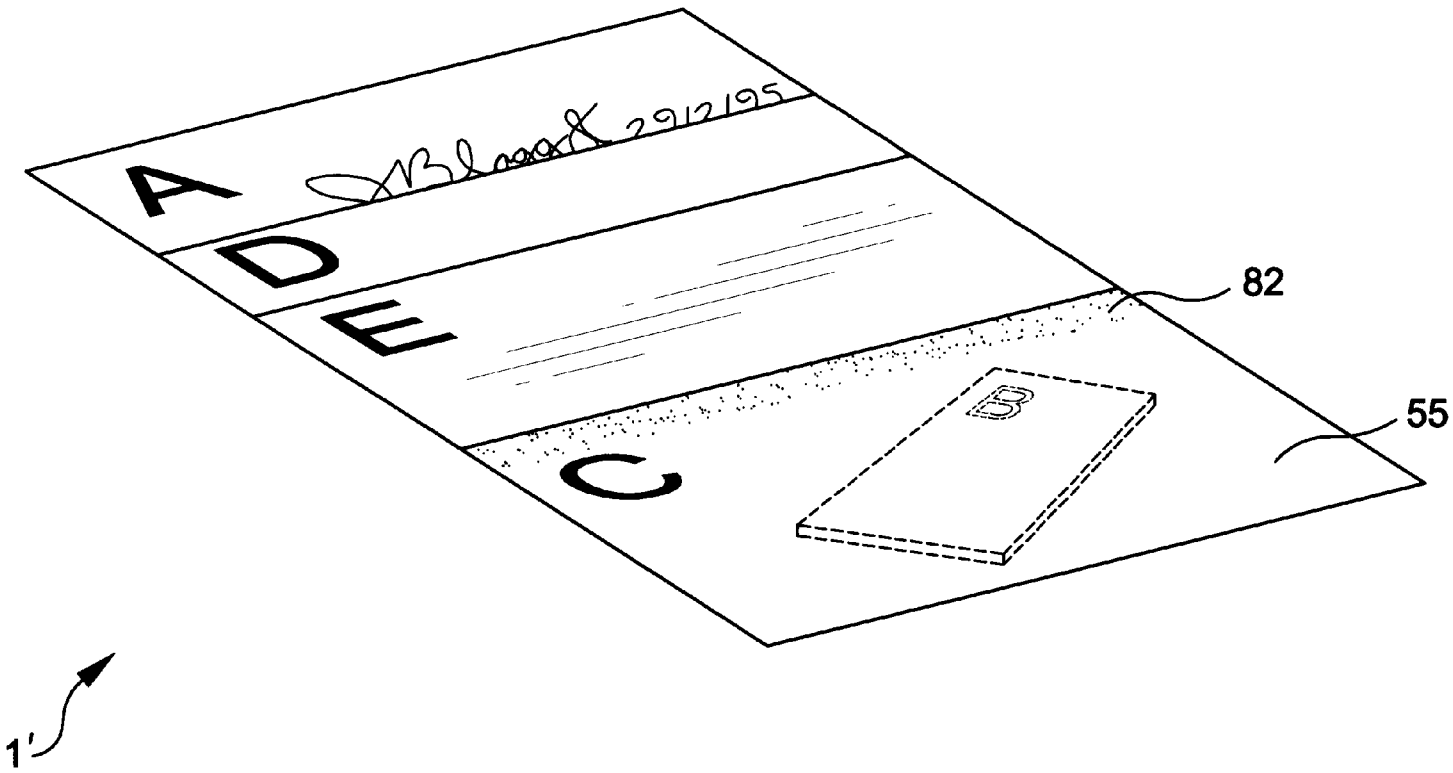
FIG. 9 is a perspective view of the envelope of the second embodiment with the portion B in the auxiliary pocket formed between portion C and the intermediate panel.
Figure 10:
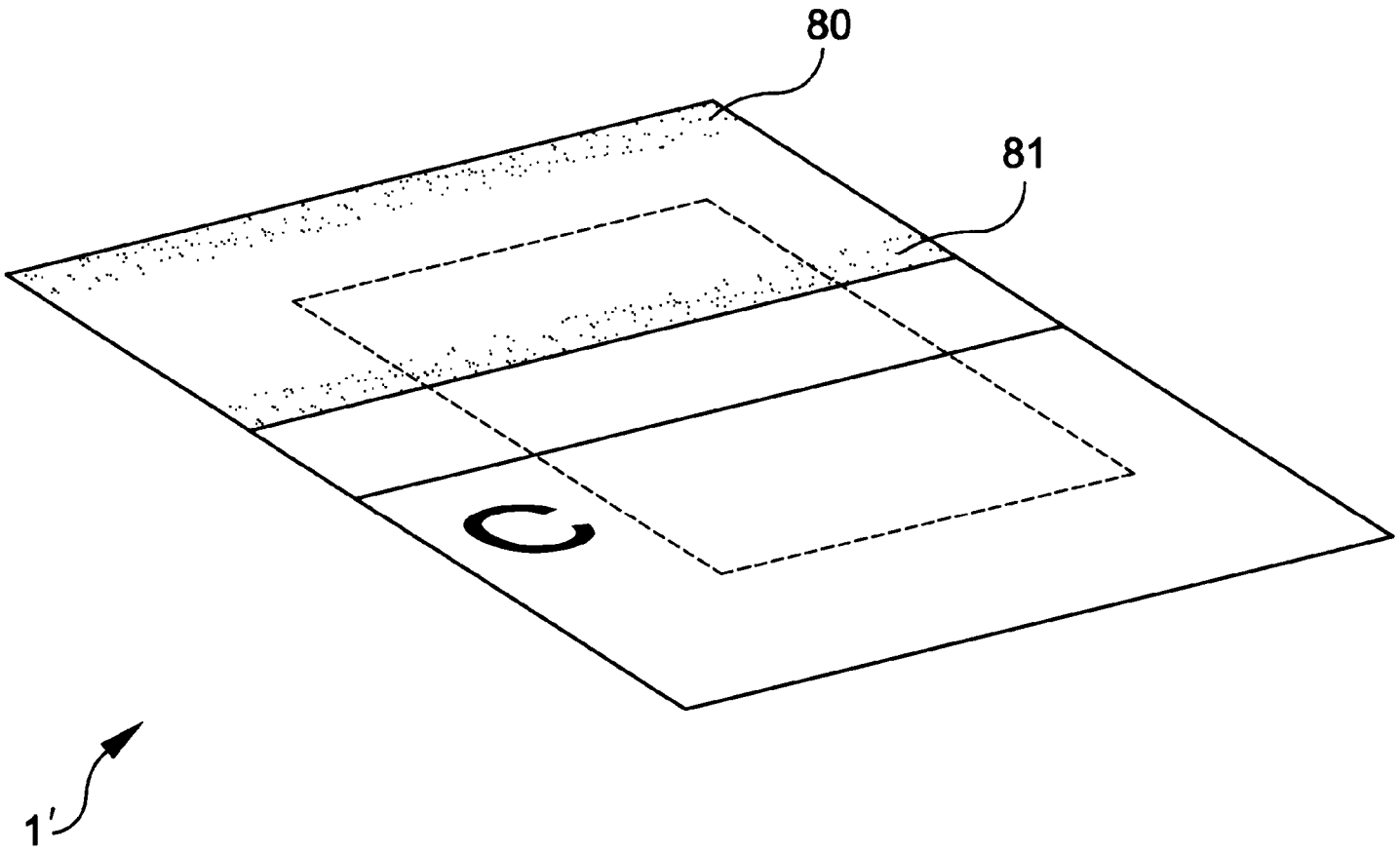
FIG. 10 is a perspective view of the sealed envelope of the second embodiment.

The envelope 1' is provided with adhesive strips which are covered by a protective covering. These adhesive strips are located at the following locations:

(1) on sub-panel A along the edge 58 thereof, this adhesive strip is indicated by numeral 80 on FIG. 10;

(2) on the base panel 70 located just above the mouth of the main pocket 65; this adhesive strip is indicated by numeral 81 on FIG. 10;

(3) across the rear of the sub panel C just inside the mouth of the auxiliary pocket 55; this adhesive strip is indicated by the numeral 82 on FIG. 9. The portions of the two opposed side edges of panel C which are covered by the adhesive strip 82 are not connected to the intermediate panel 60. This is convenient since it allows the mouth of the auxiliary pocket 55 to be opened wider than would otherwise be the case and the end edges of the adhesive strip 82 can easily be accessed by a user's fingers to peel off the protective covering from the adhesive strip 82.

Figure 7:
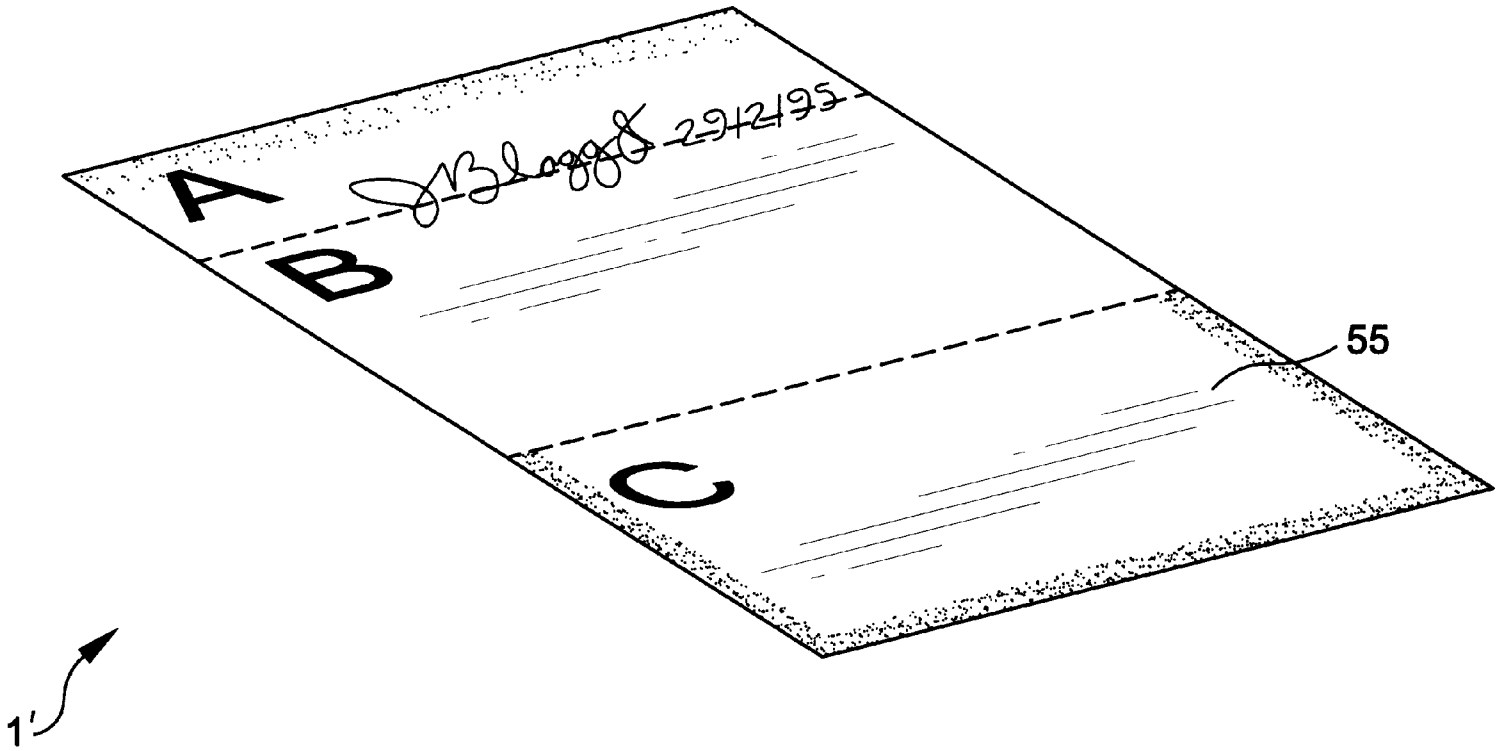
FIG. 7 is a perspective view of the top panel of the envelope of the second embodiment.
Figure 8:
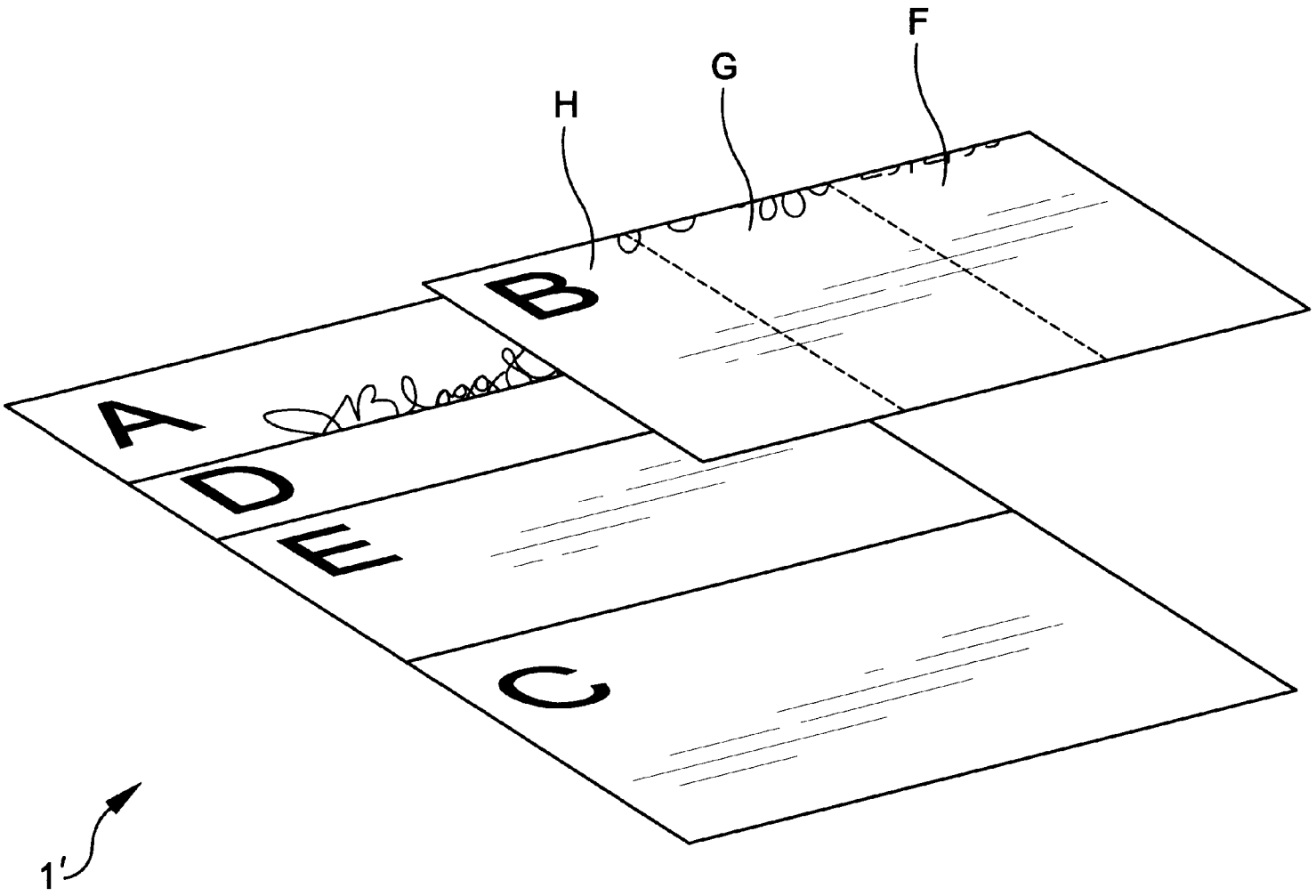
FIG. 8 is an exploded perspective view of the assembled envelope, with portion B separated from the top panel.

The method for using the envelope of the invention is as follows:

(1) the user's signature and the date are written in pen within the boundary of the top panel 50 along the perforated line 51 so that the perforated line 51 runs through the full length of the written text as indicated on FIG. 7;

(2) the sub-panel B is then detached by tearing through the respective perforated lines 51,52 with some of the written text now being provided on sub-panel B, and the remainder being on sub-panel A; since sub-panel B is not adhered to either the intermediate panel 60 or the base panel 70, it is conveniently easy to tear along both perforated lines 51,52;

(3) on the reverse side of portion B, the user's signature and date are inscribed in pen in the spaces provided on a Declaration of ownership of rights which is provided on sub-panel F, this constitutes a declaration by the user to the effect that he is the owner of the contents of the envelope 1' and claims copyright and ownership of intellectual property rights vested in the contents;

(4) the user's name and postal address are filled in the spaces provided and the appropriate boxes are ticked on sub-panel H of panel B indicating the profession to which the owner belongs;

(5) panel B is folded twice, firstly along the dotted line between respective sub-panels F and G respectively, and then subsequently between sub-panels G and H respectively;

(6) the folded panel B is inserted into the auxiliary pocket 55 provided between sub-panel C and the intermediate panel 60 (panel E);

(7) the protective strip is removed from the adhesive 82 under the mouth of sub-panel C and sub-panel C is pressed onto the adhesive so as to seal the auxiliary pocket 55;

(8) the document(s) to be protected is/are inserted in the main pocket 65 formed between intermediate panel E and base panel 70 (panel D);

(9) the protective strips are removed from the adhesive 80 and 81, and folded at the creases between D and E. Sub-panel A and panel D are simultaneously folded over onto panel E thereby sealing the mouth of the main pocket 65 using the adhesive 80,81; and

(10) the envelope of the invention is then dispatched/delivered to a registration depository.

The additional advantage of the envelope 1' over envelope 1 is that the documents to be protected are secured within the main pocket 65 while the receipt-defining portion (i.e. sub-panel B) bearing part of the owner's signature, is secured within auxiliary pocket 55. The envelope 1' provides an extremely convenient and secure means of forwarding the documents to be protected as well as sub-panel B to the registration depository. The registration depository personnel can then remove the sub-panel B from the auxiliary pocket 55; note and record its contents; accord a registration number to the envelope 1' and print this number on sub-panel G and then return sub-panel B to the owner for it to be kept in a safe place for later presentation if proof of ownership of the contents of the main pocket 65 of envelope 1' is required.

Sub-panel B, on which part of the owner's signature is inscribed, will be subsequently returned to the user bearing a registration number and a "protection ends by" date. If it is ever required to provide proof of existence and ownership of the contents of the envelope 1,1' as of a certain date, the receipt-defining portion (sub-panel B) together with its corresponding envelope 1' can be produced. The matching of the two portions of the signature together by aligning the portion of the signature on the receipt-defining portion and by opening the envelope to reveal the matching portion of the signature concealed within the envelope proves the owner's possession of the contents of the envelope on the date inscribed alongside the signature.

It will of course be understood that the invention is not limited to the specific details described herein, which are given by way of example only, and that various modifications and alterations are possible within the scope of the invention as defined in the appended claims.

What is claimed is:

1. An envelope for holding contents and receiving a date-indicating means, said envelope comprising:

a base panel having an upper portion and lower portion;

an intermediate panel being connected to said lower portion of said base panel to form a main pocket;

a top panel having first and second connection lines that divide said top panel into first, second and third sub-panels, said first sub-panel being fixed to said intermediate panel to form an auxiliary pocket, said second sub-panel being a removable receipt-defining portion and said third sub-panel being fixed to said upper portion of said base panel;

said top, intermediate and base panels being rectangular and having equal widths, said top and base panel having equal lengths and said intermediate panel having a length that is shorter than said base panel;

a closure flap including said upper portion of said base panel and said third sub-panel, said closure flap being movable between an open position that allows the contents to be placed within said main pocket and a closed position for sealing the contents within said main pocket; and a field having first and second parts for receiving the date-indicating means, said field being positioned along said second connection line between said second and said third sub-panels with said first part being a portion of said third sub-panel and said second part being a portion of said receipt-defining portion, wherein after applying the date-indicating means and detaching said receipt-defining portion, said closure flap seals said first part of said field when in said closed position.

2. An envelope as defined in claim 1, wherein said field is defined by lines.

3. An envelope as defined in claim 1, wherein said field is defined by an array of different colors.

4. An envelope as defined in claim 1, further comprising a declaration of ownership rights provided on said receipt-defining portion.

5. An envelope as defined in claim 1, wherein said first and second connection lines are formed as a line of perforations.

6. An envelope as defined in claim 1, further comprising an adhesive strip provided on said first sub-panel to seal said auxiliary pocket.

7. A method of documenting a date of deposit of an envelope at a registration depository, said method comprising the steps of:

(a) providing an envelope for holding contents and receiving a date-indicating means comprising:

a plurality of panels connected together to form at least one pocket;

a closure flap moveable between an open position that allows the contents to be placed within said pocket and a closed position for sealing the contents within said pocket;

a receipt-defining portion detachable connected to one of said plurality of panels by at least one connection line;

a field for receiving the date-indicating means and positioned along said connection line, wherein after applying the date-indicating means and detaching said receipt-defining portion, said closure flap seals a remaining part of said field when in said closed position;

(b) applying a date-indicating means to said field of said envelope across said connection line;

(c) detaching said receipt-defining portion from said envelope with a portion of said date-indicating means being provided on said receipt-defining portion and a remaining portion of said date-indicating means on said envelope;

(d) inserting contents into said pocket of said envelope and sealing said pocket; and (e) delivering said envelope to the registration depository.

8. A method of documenting a date of deposit of an envelope as defined in claim 7, wherein said envelope being provided has at least first and second pockets with said contents being inserted into said first pocket; said method further comprising the step of:

inserting said receipt-defining portion into said second pocket and sealing said second pocket before delivering said envelope to the registration depository.

* * * * *

UNITED STATES PATENT AND TRADEMARK OFFICE

CERTIFICATE OF CORRECTION

PATENT NO. : 6,062,465

DATED : May 16, 2000

INVENTOR(S) : Hugh Kearns

It is certified that error appears in the above-identified patent and that said Letters Patent is hereby corrected as shown below:

In Column 3, line 36, now reads "fist and second parts 16, 71"

should read --first and second parts 16, 17--

Signed and Sealed this

Twenty-seventh Day of March, 2001

*Attest:*

NICHOLAS P. GODICI

*Attesting Officer*

*Acting Director of the United States Patent and Trademark Office*